United States Patent [19]

Watanabe

[11] 4,362,176

[45] Dec. 7, 1982

[54] DEVICE FOR ADJUSTING COIN PASSAGE OF COIN HANDLING MACHINE

[75] Inventor: Kenkichi Watanabe, Tokyo, Japan

[73] Assignee: Laurel Bank Machine Co., Ltd., Tokyo, Japan

[21] Appl. No.: 184,779

[22] Filed: Sep. 8, 1980

[30] Foreign Application Priority Data

Dec. 25, 1979 [JP] Japan ..... 54-179749[U]

[51] Int. Cl.[3] ..... G07D 9/00

[52] U.S. Cl. ..... 133/1 A; 133/8 A

[58] Field of Search ..... 198/836; 133/1 A, 1 R, 133/5 R, 8 R, 8 A; 53/212, 254; 193/DIG. 2

[56] References Cited

U.S. PATENT DOCUMENTS 3,347,249 10/1967 Becker ..... 53/254
4,098,056 7/1978 Ozaki ..... 53/212
4,173,232 11/1979 Asami et al. .

FOREIGN PATENT DOCUMENTS 2625698 12/1977 Fed. Rep. of Germany ..... 53/212
52-26295 2/1977 Japan .

*Primary Examiner*—H. Grant Skaggs
*Attorney, Agent, or Firm*—Fleit & Jacobson

[57] ABSTRACT

There is provided an improved device for adjusting a coin passage of a coin handling machine, wherein two coin selection guides defining the coin passage are moved relative to each other. The device comprises two sliders connected respectively to the two coin selection guides, a link pivoted at the point substantially centrally of the longitudinal extension thereof and having ends connected to the sliders for resiliently urging the ends of the link to engage members respectively fixed to the sliders and a cam abutting directly or indirectly against one of the ends of the link for moving the same by a pre-set distance in response to the change in diameter of the coins to be passed through the coin passage. By the use of the device according to the invention, said sliders are moved in the directions reverse to each other by the same distance so as to move the associated coin selection guides to increase or decrease the width of the coin passage without changing the longitudinal center line of the passage. Malfunction of the machine including jamming and false stacking of the coins caused by the misalignment of the center axes of the coin passage and the coin receiving accumulator tube can be advantageously precluded by the use of the device of the invention.

5 Claims, 3 Drawing Figures

DEVICE FOR ADJUSTING COIN PASSAGE OF COIN HANDLING MACHINE

BACKGROUND OF THE INVENTION

1. Field of the Invention

The present invention relates to a device for adjusting the coin passage of a coin handling machine by which coins are assorted or counted, and particularly to an improvement in the adjuster for adjusting the width of the coin passage in response to the diameter of the coins to be assorted to allow the coins to pass through the thus adjusted coin passage successively one by one.

2. Prior Art

In the prior art device, only one of the selection guides is moved to adjust the width of the coin passage, whereas the other is fixed stationarily. However, such prior art device has a disadvantage that the center line of the coin passage along which the centers of coins pass successively is deflected in response to the width of the coins of each specie to be selectively handled, occasionally leading to misalignment with the center of the accumulator tube for receiving a pre-set amount of coins. As a result, some of the falling coins abut against the wall of the tube at the deflected side to move downwardly while being inclined from the horizontal state from the top opening of the accumulator tube to the bottom thereof, the tube having, in general, a diameter only slightly larger than those of the coins to be accumulated therein, often resulting in falsely stacked coin cylinder including one or more coins overlapped one after another in the inclined conditions or resulting in blockage by a coin. In order to preclude the aforementioned disadvantage, there has been proposed an apparatus wherein both of the selection guides move in the sideward directions by the same amounts to be apart from or close to each other, whereby the width of the coin passage may be changed to adapt for a certain sort or species of coin while maintaining the center line of the coin passage to be aligned or coincident with the center of the accumulator tube, irrespective of the change in diameter of the coins to be handled at every operation cycles. Examples of such apparatus are disclosed in Japanese Patent Laid-Open Publication No. 26295/1977. However, prior art apparatus of such kind are of intricate construction, and can not effect delicate adjustments with attendant disadvantage that a coin of different species or sort having an approximate diameter as those of the coins to be accumulated in the accumulator tube tends to be mixed erroneously.

DESCRIPTION OF THE INVENTION

The object of the present invention is to eliminate the disadvantages of the prior art apparatus mentioned before.

More specifically, the object of the present invention is to provide an aforementioned kind of device whereby both of right and left selection guides defining the width of the coin passage are co-operatively moved to adjust the width of the passage to a pre-set width.

The present invention is directed to an improvement in coin passage adjusting device used in a coin handling machine which is extremely simple in construction and yet capable of effecting delicate adjustment.

More specifically, the aforementioned object of the present invention is accomplished by the provision of a device for adjusting the coin passage of a coin handling machine comprising two coin selection guides defining the coin passage and for moving relative to each other, two slider means connected respectively to said two coin selection guides, a link pivoted at the point substantially centrally of the longitudinal extension thereof and having ends connected to said slider means, means for resiliently urging said ends of said link to engage members respectively fixed to said slider means, and cam means abutting directly or indirectly against one of said ends of said link for moving the same by a pre-set distance in response to the change in diameter of the coins to be passed through said coin passage, whereby said slider means are moved in the directions reverse to each other by the same distance so as to move the associated coin selection guides to increase or decrease the width of said coin passage without changing the longitudinal center line of the passage.

According to a preferred embodiment of the invention, spring means and rollers are used as said means for resiliently urging said ends of said link to engage members respectively fixed to said slider means.

According to another preferred embodiment, a stopper for stopping the movement of the coins at the desired time is mounted on either one of said coin selection guides.

According to a further preferred embodiment, there is provided a device further including means operated by hand for removing a coin which causes jamming.

DESCRIPTION OF THE DRAWINGS

Other objects and advantages of the present invention will become apparent from the following detailed description of the presently preferred embodiments with reference to the accompanying drawings, in which.

DESCRIPTION OF THE PREFERRED EMBODIMENTS

The preferred embodiments shown in the appended drawings will be described in detail.

Figure 1:
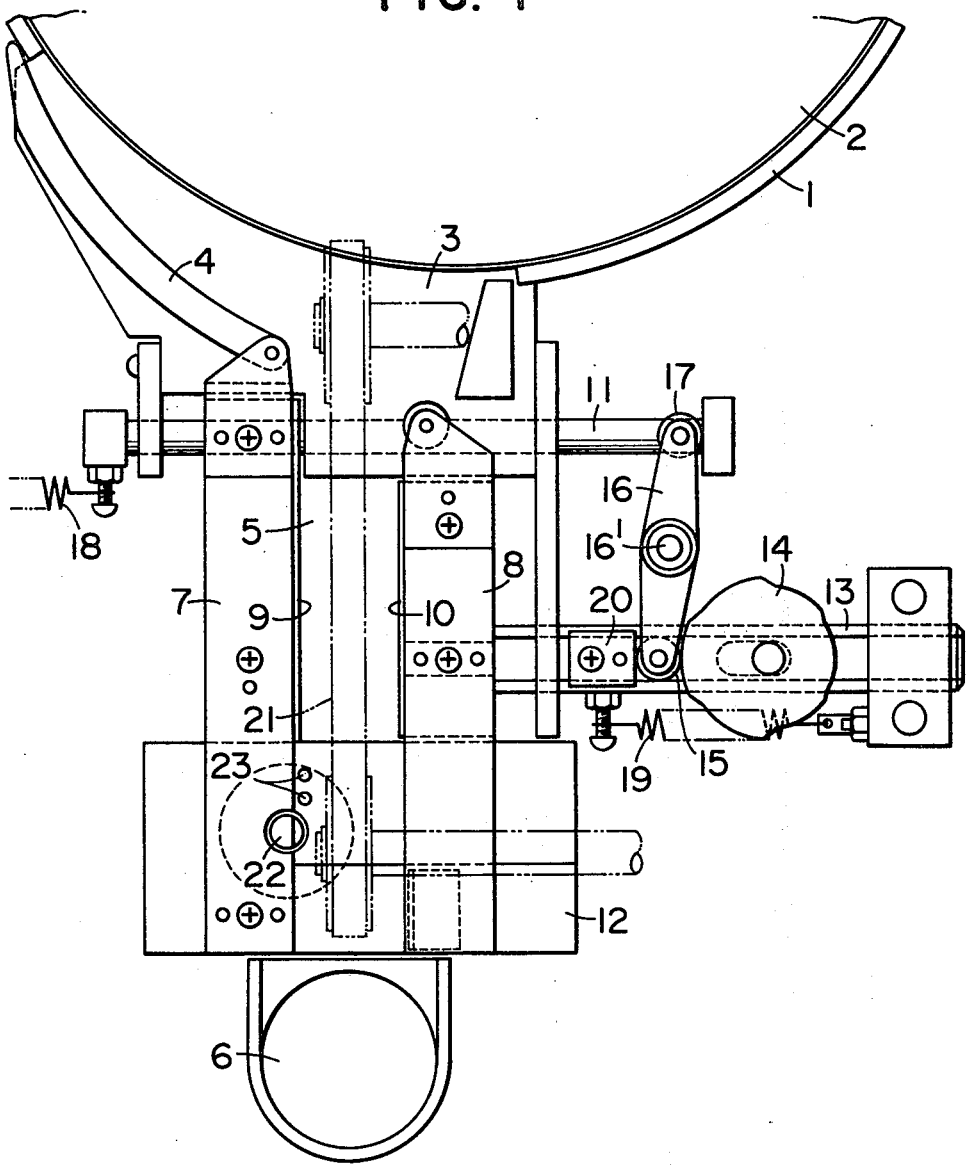
FIG. 1 is a plan view showing the main parts of one embodiment of the invention.

Referring first to FIG. 1, coins are fed on a rotary disk 2 surrounded by an outer peripheral wall 1 having a cut-off portion. The cut-off portion forms a coin introduction port of a coin introduction section 3 which has an introduction guide 4 for introducing and guiding coins one by one to a coin passage 5. Coins fed to the coin passage 5 slide therethrough successively to pass toward an accumulator tube 6.

The coin passage 5 includes selection guides 7 and 8, respectively provided with guide rails 9 and 10. The selection guide 7 disposed along one side of the coin passage 5 has the end portions, one of which is slidably guided on a slider 11 and the other of which is slidably guided on a base plate 12. The selection guide 8 disposed along the other side of the coin passage 5 is secured to a slider block 13 protruding from the substantialy center portion of the length of the selection guide 8 in the outward direction, and has end portions slidably carried by the coin introduction section 3 and the base plate 12.

A cam 14 to be rotated responsive to the diameter of a certain kind of coins by a pre-set angle is mounted on the slider block 13. The cam face of the cam abuts against a cam follower 15 rotatably mounted on one end of a link 16 which is pivoted at 16'. It is preferred that the cam follower 15 be a roller. The other end of the link 16 carries a roller 17 which engages with the slider 11. In the illustrated embodiment, the link 16 is pivotally mounted at 16', as described hereinabove, which is positioned centrally of the link 16. However, the link 16 is not necessarily pivoted about the point indicated but may be positioned at any desired point intermediate of the extension from the axis of the roller 17 and the axis of the rotatable cam follower 15.

A spring 18 acts to urge the roller 17 to engage with a contact edge of the slider 11, and another spring 19 acts to urge a cam follower 15 to engage with the cam face through a block 20 which is positioned at the side of the roller opposed to the cam 14. A coin conveying belt 21 is provided as shown by the phantom line for moving the coins through the coin passage 5 toward the discharge end of the passage to feed them into the accumulator tube 6.

The selection guide 7 is provided with a stopper 22 which is generally cylindrical but has the top face formed with a substantially semi-circular cut-off section at the position near the discharge end of the coin passage 5. The depth of the cut-off or recessed section is determined such that the face thereof is flush with the top face of the residual portion of the coin passage 5 to form an even passage floor for the coins when the stopper 22 is rotated at the passing position with the diametrically extending edge of the recessed portion to the aligned with the edge of the selection guide. If it is desired to stop the coins in the course of the operation to prevent them from falling down into the accumulator, the stopper 22 is rotated to block the leading coin by either of the diametrically extending edges of the recessed section or the outer periphery of the not-cut-off section of the stopper 22. Alternatively, the stopper may be a semicircular disk or mounted eccentrically. It is believed that the construction and operation of such stopper is within the scope of common knowledge which may be easily made by those skilled in the art. Moreover, the specific construction of the stopper is not an essential feature of the present invention, so that no more detailed description thereof will be given here. Further provided at the vicinity of the discharge end of the coin passage 5 are optical counting means, such as photo-sensors, for counting the number of the passing coins. Other types of counting means may be used for the same purpose without departing from the scope of the present invention. However, it is essential that said stopper shall be moved together with the selection guide 7 in the right and left directions as viewed in the Figure to be adapted for passing any selected coins therethrough when it is positioned at the passing position.

Figure 2:
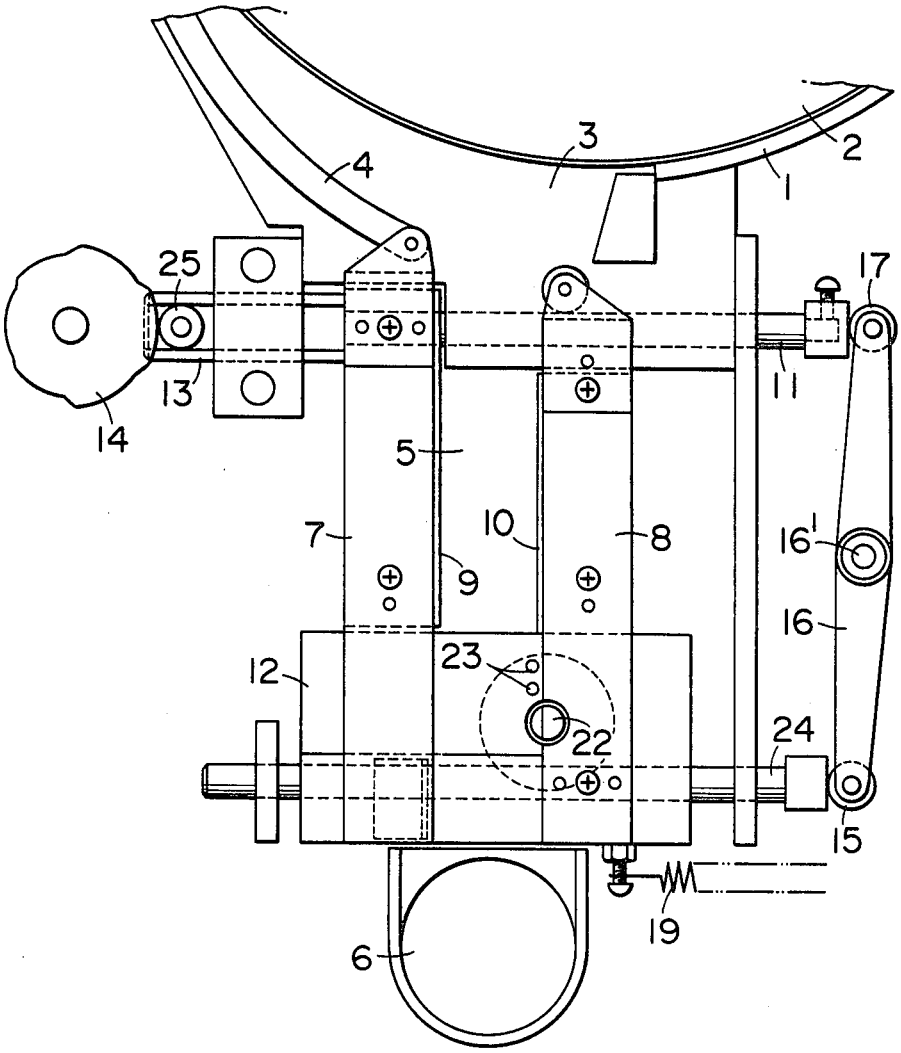
FIG. 2 is a plan view showing the main parts of another embodiment of the invention.

Another embodiment of the invention is shown in FIG. 2. The construction and operation of this embodiment are similar with those of the preceding embodiment except in the following respects, and similar parts are designated by the same reference numerals.

In the embodiment shown in FIG. 2, a further slider 24 is disposed at the vicinity of the discharge end of the coin passage such that it occupies the position opposing to said slider 11, and the selection guide 7 is secured to the slider 11 whereas the other selection guide 8 is secured to the slider 24. One end for each of the sliders 11, 24 is connected to each end of a link 16 to be linked with each other. The link 16 is pivoted at 16' as shown, and the ends of the link 16 abut against the rollers 15, 17 mounted to the ends of the sliders 11, 24, respectively. A spring 19 ensures the abutments between the link 16 and the rollers 15, 17. In this embodiment, the cam 14 co-operates with a roller 25 directly mounted on the slider 11, and the stopper 22 is mounted on the selection guide 8. However, the stopper 22 may be mounted on the other selection guide 7, as desired.

Figure 3:
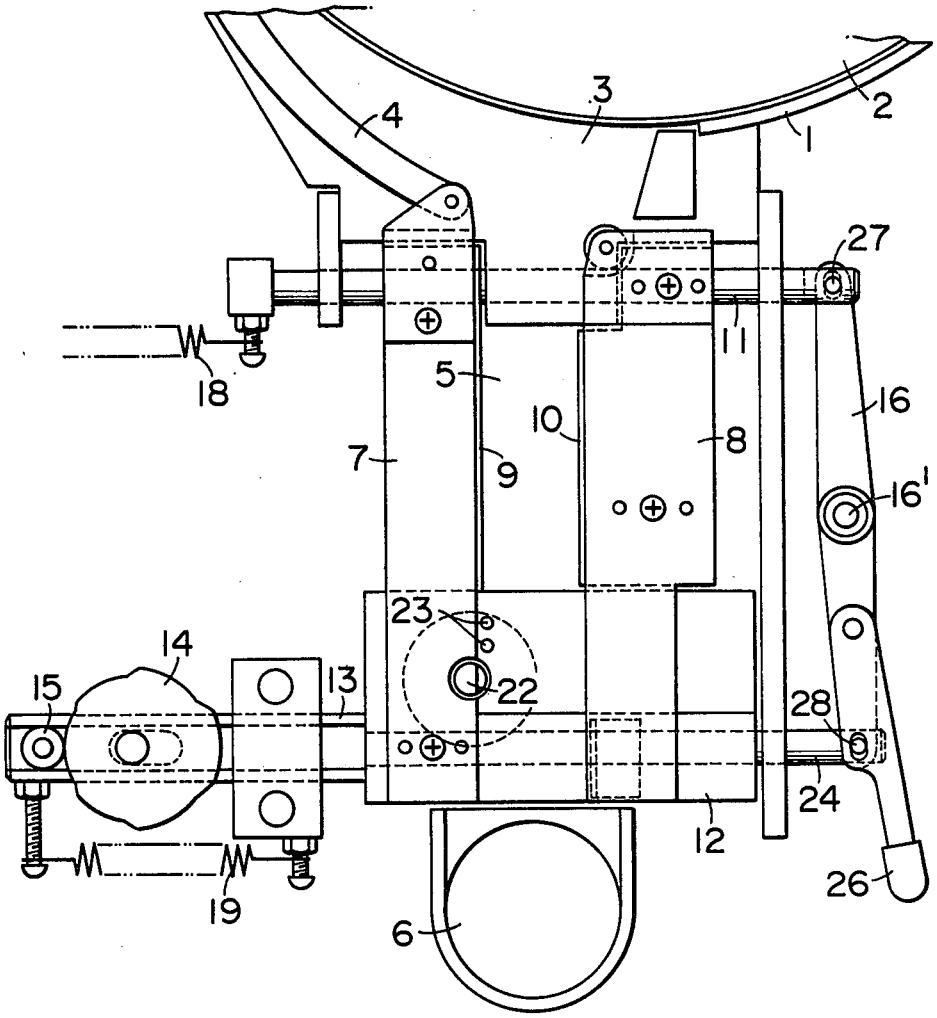
FIG. 3 is a plan view showing the main parts of a further embodiment of the invention.

A further embodiment of the present invention is shown in FIG. 3. This embodiment is generally similar to the second embodiment described as above, but provided with means for removing a coin causing jamming, such as the one which is deformed or deflected, to interrupt the passing of the subsequent coins. Since the parts other than those which will be described below are the same as those of the preceding second embodiment, only the parts and the operations thereof which are different from those of the second embodiment will be described in the following descriptions.

The sliders 11 and 24 are connected with the ends of the link 16 through pins 27 and 28, and the roller 15 abuts against the diametrically opposing face of the cam 14 as compared to the second embodiment. Further, there is provided a handle 26 to be operated by hand for opening the selection guides 7 and 8 in the directions such that they are separated remoter with each other. Although it is preferred that the handle 26 has a fulcrum at a point on the link 16, as shown in FIG. 3, and engages with a pin 27 for the easy operation by a small operational force, it should be anticipated that the handle may be mounted directly on either of the sliders 24 or 11.

In each of the aforementioned embodiments, in operation, when the cam 14 is rotated, the cam follower 15 is moved responsive to the rotation of the cam while engaging therewith. Whereupon, the link 16 pivots about the pivoted point 16' to move the roller 17 or the pin 27 in the direction reverse to the moving direction of the slider block 13 to increase or decrease the opening width of the coin passage 5. As the result, the center line or longitudinal axis of the coin passage 5 is not changed and maintained at the original position irrespective of the change in diameter of the coins to be passed through the passage 5. If the longitudinal axis of the coin passage 5 has been once aligned with or coincident with the center axis of the accumulator tube 6, the coins are passed to and stacked in the tube in good order even after the diameter of the coins being handled in the machine is changed.

As will be clearly understood by those skilled in the art, according to the present invention, the link mechanism for moving the selection guides disposed along both sides of the coin passage are co-operated by the action of engagement under pressure between the members at least one of which is a rotatable roller or a cylindrical pin. As a result, disadvantageous play or backlash due to the mechanical tolerance in manufacturing is precluded to make it possible to adjust the width of the coin passage delicately and precisely, Moreover, according to the preferred embodiment of the invention, the selection guides disposed along both sides of the coin passage move by the same distance at every operation to make it possible to simplify the construction and to increase the practical utility.

What is claimed is:

1. In a device for adjusting a coin passage of a coin handling machine so as to adapt the width of the coin passage for a certain sort of coins, wherein two coin selection guides defining the coin passage are moved relative to each other, the improvement which comprises:

two slider means connected respectively to said two coin selection guides and having engagement portions;

a link pivoted at a point substantially centrally of a longitudinal extension thereof and having ends engageable with engagement portions of respective ones of said slider means;

means for resiliently urging said ends of said link to engage said engagement portions of each of said slider means;

cam means abutting against one of said ends of said link for moving the same by a pre-set distance in response to a change in diameter of coins to be passed through said coin passage;

whereby said slider means are slidably moved in directions reverse to each other by the same distance so as to move the associated coin selection guides to increase or decrease the width of said coin passage without changing the longitudinal center line of the coin passage; and stopper means mounted on one of said coin selection guides for stopping the movement of coins at any desired time, said stopper means comprising a rotatable member having a semi-circular cut-off section, the diametrically extending edge of said semi-circular cut-off section being selectively aligned with an edge of the associated coin selection guide defining one of the walls of the coin passage for passage of coins and being positionable skewed to the coin selection guide edge to stop movement of coins.

2. A device as claimed in claim 1, wherein said means for resiliently urging said ends of said link to engage said engagement portions includes springs acting on the associated slider means and rollers rotatably mounted at the substantial ends of the link.

3. A device as claimed in claim 1 or 2, further including means operable by hand for removing a coin which causes jamming of the coin passage.

4. A device according to claim 1, wherein said rotatable member is a disk.

5. A device according to claim 1, wherein said rotatable member is a cylinder.

* * * * *